US008201824B2

(12) United States Patent
deJong et al.

(10) Patent No.: US 8,201,824 B2
(45) Date of Patent: Jun. 19, 2012

(54) VARIABLE FORCE NIP ASSEMBLY

(75) Inventors: Joannes N. M. deJong, Hopewell Junction, NY (US); Lloyd A. Williams, Mahopac, NY (US); Matthew Dondiego, West Milford, NJ (US)

(73) Assignee: Xerox Corporation, Norwalk, CT (US)

( * ) Notice: Subject to any disclaimer, the term of this patent is extended or adjusted under 35 U.S.C. 154(b) by 1 day.

(21) Appl. No.: 12/547,105

(22) Filed: Aug. 25, 2009

(65) Prior Publication Data

US 2011/0049800 A1 Mar. 3, 2011

(51) Int. Cl.
*B65H 5/06* (2006.01)

(52) U.S. Cl. ..... 271/274; 271/272; 271/273

(58) Field of Classification Search ..... 271/272, 271/273, 274

See application file for complete search history.

(56) References Cited

U.S. PATENT DOCUMENTS

| | | | | |
|---|---|---|---|---|
| 6,141,883 | A * | 11/2000 | Mitchell et al. | 33/501.02 |
| 6,857,631 | B2 * | 2/2005 | Morrison et al. | 271/274 |
| 7,429,042 | B2 * | 9/2008 | Ban et al. | 271/274 |
| 7,431,292 | B2 * | 10/2008 | Goto | 271/272 |
| 7,523,933 | B2 * | 4/2009 | Linder et al. | 271/274 |
| 7,654,528 | B2 * | 2/2010 | Abe et al. | 271/274 |

* cited by examiner

*Primary Examiner* — Kaitlin Joerger
(74) *Attorney, Agent, or Firm* — Hoffmann & Baron, LLP

(57) ABSTRACT

An apparatus and method for transporting substrate media including a nip assembly having a drive wheel operably connected to a drive mechanism for rotating the drive wheel, and an idler member disposed adjacent the drive wheel. The idler wheel and drive wheel forming a nip. The drive wheel and idler wheel are displaceable from each other to form a nip gap therebetween. A nip force generator is operably connected to the nip assembly. The nip force generator develops a first nip force upon entry of the substrate media into the nip and formation of the nip gap and develops a second nip force subsequent to the first nip force. The second nip force is greater than the first nip force.

21 Claims, 3 Drawing Sheets

VARIABLE FORCE NIP ASSEMBLY

TECHNICAL FIELD

The present disclosure generally relates to document processing devices and methods for operating such devices. More specifically, the present disclosure relates to a substrate media transport system with reduced force nip to mitigate nip entrance disturbances that affect registration of a substrate media.

BACKGROUND

In document processing devices, accurate and reliable registration of the substrate media as it is transferred in a process direction is desirable. Even a slight skew or misalignment of the substrate media through an image transfer zone can lead to image and/or color registration errors. Such registration errors can occur as the substrate media passes through the nips.

Document processing devices typically include one or more sets of nip assemblies used to transport substrate media, such as sheets of paper, through the device. A nip assembly provides a force to the sheet as it passes through a nip to propel it through the document processing device. A nip assembly typically includes a drive wheel and an idler wheel in rolling contact with the drive wheel. One or more sets of drive wheels and idler wheels may be longitudinally aligned in order to form the nip therebetween. The driving wheel and the idler wheel may be urged together by a biasing device which in turn creates the nip force. The nip force is required such that the wheels properly engage the sheet as it passes through the nip. This nip force must be significant enough in order to eliminate slipping between the drive wheel and the sheet.

When a sheet being transported through the document processing device first engages the nip, the drive wheel and idler wheel are in rolling engagement with each other. As the sheet engages the wheels, at least one of the idler and drive wheels typically moves against the nip force in order to permit the sheet to enter the nip. The entering of the sheet, especially thick sheets, into the nip results in nip disturbances which negatively affect sheet registration. When a sheet enters a nip, the sheet must perform work in displacing the wheel of an amount equal to its thickness multiplied against the nip force. This work needs to be performed in the time it takes the sheet to fully enter the nip. The work required to move the wheel originates from a decrease in kinetic energy, i.e., speed, of the rotating nip components. The controls used to regulate the nip velocity typically cannot effectively mitigate the nip disturbances. Registration of the sheets, therefore, is compromised.

Accordingly it would be desirable to provide a substrate media transport system having nip assemblies that reduce the disturbance caused by substrate media entering the nips.

SUMMARY

There is provided an apparatus for transporting substrate media including a nip assembly having a drive wheel operably connected to a drive mechanism for rotating the drive wheel, and an idler member disposed adjacent the drive wheel. The idler wheel and drive wheel forming a nip. The drive wheel and idler wheel are displaceable from each other to form a nip gap therebetween. A nip force generator is operably connected to the nip assembly. The nip force generator develops a first nip force upon entry of the substrate media into the nip and formation of the nip gap and develops a second nip force subsequent to the first nip force. The second nip force is greater than the first nip force.

There is also provided an apparatus for mitigating nip disturbances caused by substrate media entering the nip including a nip assembly having a drive member operably connected to a drive mechanism for rotating the drive wheel. The nip assembling further including an idler member is disposed adjacent the drive wheel. The drive and idler wheels being movable relative to each other to form a nip gap therebetween. A first force generating device generates a first nip force which acts upon the nip assembly upon an initial separation of the drive member and the idler member. A second force generating device selectively generates a second nip force which acts upon the nip assembly in response to a predetermined condition, the second nip force being greater than the first nip force.

There is still further provided a method of mitigating nip entrance disturbances including;

transporting substrate media toward a nip formed between a drive wheel and an idler wheel, the drive wheel and idler wheel being displaceable from each other by action of the substrate media to form a nip gap;

subjecting the substrate media to a first nip force upon entry of the substrate media into the nip and during displacement of the idler wheel from the drive wheel by the substrate media; and subjecting the substrate media to a second nip force subsequent to the first nip force, the second nip force being greater than the first nip force.

DETAILED DESCRIPTION

Figure 1:
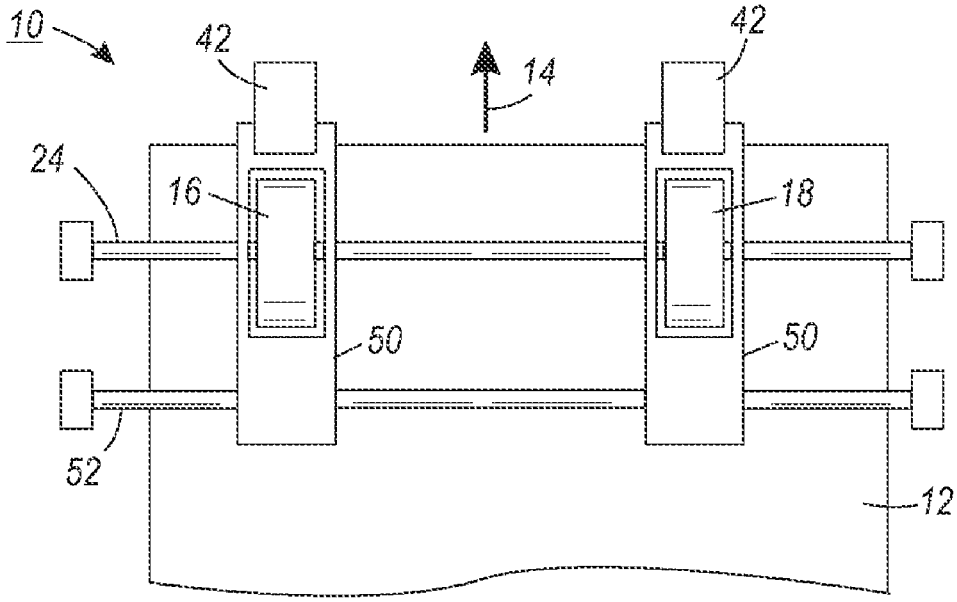
FIG. 1 is a top perspective schematic view of a sheet transport system according to an embodiment.

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "substrate of media" refers to, for example, paper, transparencies, parchment, film, fabric, plastic, or other substrates on which information can be reproduced, for example, in the form of a sheet or web.

A "nip" refers to a location in a document processing device at which a sheet is propelled in a process direction. A nip may be formed between an idler wheel and a drive wheel.

A "nip assembly" refers to components, for example and without limitation, a drive wheel and an idler wheel which form a nip.

A "drive wheel" refers to a nip assembly component that is designed to propel a sheet in contact with the nip. A drive wheel may include a wheel, roller or other rotable member. The drive wheel may have an outer surface including a compliant material, such as rubber, neoprene or the like. A drive wheel may be directly driven via a stepper motor, a DC motor or the like. Alternately, a drive wheel may be driven using a gear train, belt transmission or the like.

An "idler wheel" refers to a nip assembly component that is designed to provide a normal force against a sheet in order to enable the sheet to be propelled by the drive wheel. An idler wheel may include a wheel, roller or other rotatable member. The idler wheel may have an outer surface including a noncompliant material, such as plastic.

A "nip force" refers to a force acting upon substrate media when transported through a nip.

A "nip force generator" refers to a device, for example a mechanical, electro-mechanical, fluid power device, for exerting a nip force.

A "nip gap" refers to a space formed between a drive wheel and idler wheel of a nip assembly.

"Nip disturbances" refers to influences on nip components that affect desired operation of the nip assembly components.

With reference to FIGS. 1-4, a substrate media transport system 10 conveys substrate of media such as sheet of media 12 along a processing path 14. The substrate media transport system may include one or more nip assemblies 16 longitudinally aligned transverse to the process direction 14. Each nip assembly 16 may include an idler wheel 18 and a drive wheel 20 which form a nip 21 therebetween. The idler wheel 18 and drive wheel 20 may be biased together creating a nip force shown by arrow 17. The nip force 17 acts on a sheet 12 that is being transported by the substrate media transport system 10 in order to enable the sheet to be propelled by the rotating drive wheel 20. The idler wheel 18 may have an outer surface 22 including a noncompliant material, such as hard plastic. The idler wheel 18 may rotate around a shaft 24.

The drive wheel 20 may include an outer surface 32 having a compliant material such as rubber, neoprene or the like. The compliant material helps to grip the sheet 12 and permit the drive wheel 20 to move the sheet through the nip 21. The drive wheel 20 rotates about a drive shaft 34 and may be directly driven by a drive motor 36, such as a stepper motor, a DC motor or the like. A transmission device 38 may extend between the drive motor 36 and the drive wheel 20 for imparting motion to the drive wheel 20. The transmission device 38 may include a timing belt, gear trains or other transmission means known to those of ordinary skill in the art. The drive wheels 20 of each of the nip assemblies 16 may move in a coordinated manner to propel the sheets 12 through the nips 21 in a controlled manner.

When a sheet approaches the nip assembly 16, the idler wheel 18 is in rolling engagement with the drive wheel 20 and the wheels are held together by the nip force 17. In order for the nip assembly 16 to operate properly, the nip force may be high enough such that the sheet is propelled through the nip 21 without slippage. As the sheet engages the nip 21, the idler and drive wheels 18, 20 are separated from each other by the sheet 12 forming a nip gap 40. If the sheet 12 were to encounter a nip held together by a high nip force of the magnitude sufficient to prevent slippage, significant nip disturbances would be created detrimentally affecting registration and component wear. Thus, in accordance with the present disclosure, each nip 21 may be operated upon by a nip force generator 42 capable of producing a varying nip force.

Figure 2:
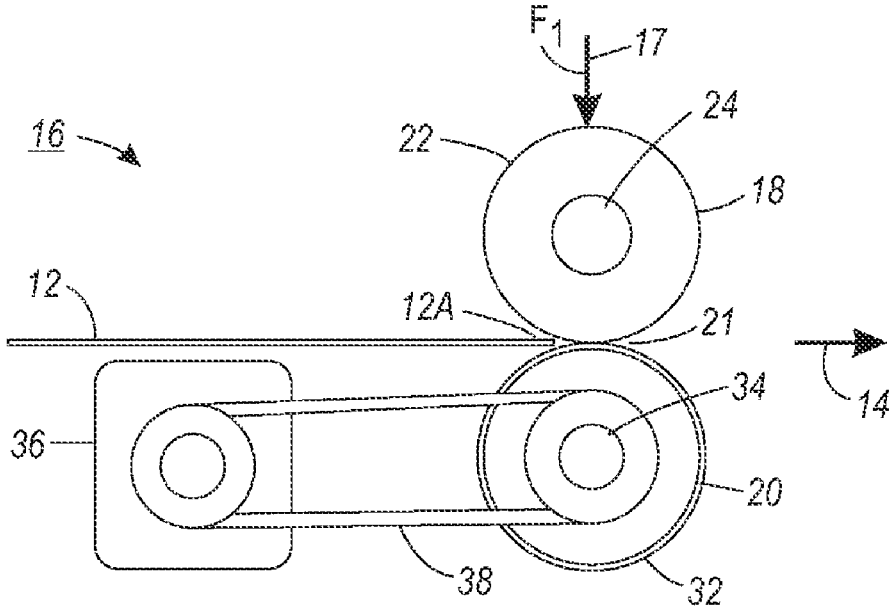
FIG. 2 is a side elevational schematic view of the sheet transport system of FIG. 1 depicting a sheet about to enter the nip.

With reference to FIG. 2, the nip force generator 42 may develop a first nip force $F_1$ which acts upon the nip assembly 16, and a sheet within the nip, when the sheet leading edge 12A first enters the nips 21. This first nip force $F_1$ may be relatively low. Since the sheet 12 is typically still being driven by an upstream transport system, the nip assembles 16 do not have to initially rely on a nip force to pull the sheet into the nips 16. The relatively low nip force $F_1$ may act on the sheet when the sheet is separating the idler wheel 18 and drive wheel 20 as the leading edge 12A enters the nips 16. The low nip force $F_1$ limits the amount of work needed to be performed by the sheet entering the nips 16, thereby reducing nip disturbances.

Figure 3:
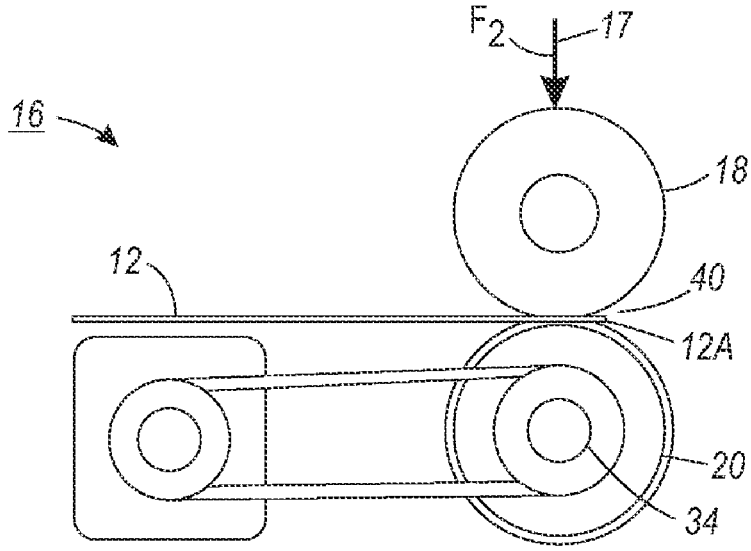
FIG. 3 is a side elevational view of a sheet transport system of FIG. 1 depicting a sheet after it has entered the nip.

With reference to FIG. 3, the nip force generator 42 may further produce a second nip force $F_2$ which acts upon the nip assemblies 16, and a sheet within the nips, after the nip gap 40 has reached the thickness of the sheet passing through the nips 21. The second nip force $F_2$ may be higher than first nip force $F_1$ and may have a value sufficient to permit the sheet to be propelled through the nips 21 without slipping. Since the idler wheel 18 and drive wheel 20 have been separated such that the sheet can pass therebetween, the sheet 12 need not work against the second nip force $F_2$.

Accordingly, the work performed by the sheet in forming the nip gap 40 is a function of the lower first nip force $F_1$. Since the sheets entering the nips 16 only work against the lower nip force, nip entrance disturbances are greatly reduced. This helps to maintain proper registration of the sheets and also reduces damage to the sheets and the nip components. However, slippage of the sheets 12 passing through the nips 16 is also reduced since the second nip force $F_2$ is applied and acts on the sheets 12 as the sheets are propelled through the nips 16.

It is further contemplated that the nip force generator may be capable of generating more that just the first and second forces. Multiple nip forces could be provided to control the operation of the nip assemblies 16 and the transfer of sheets 12 through the nips 21.

Figure 4:
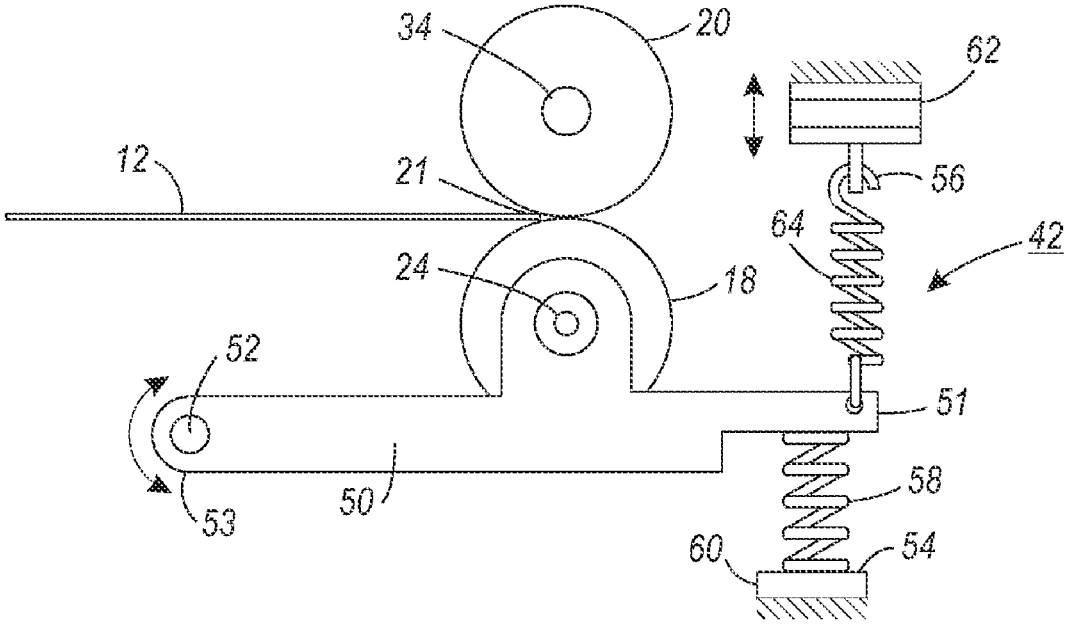
FIG. 4 is a side elevational schematic view of the sheet transport system of FIG. 1 depicting a nip force generator.

The nip force generator 42 may act on the idler wheel 18 and/or the drive wheel 20 to create the desired nip force. For purposes of description, the force generating device 42 will be described as operating on the idler wheel 18. With reference to FIG. 4, the idler wheel 18 may be rotatably connected to a ridged pivot arm 50 at a first end 51 thereof. A pivot arm second end 53 may be pivotally attached to a structure such as a shaft 52. The pivot arm 50 may move such that the idler wheel 18 may be pivoted toward and away from the drive wheel 20. The nip force generator 42 may include a first and second force generating device 54 and 56, respectively, for urging the idler wheel 18 toward the drive wheel 20 with different degrees of force. In the alternative embodiment wherein the nip force generating device 42 is attached to the drive wheel 20, the drive wheel may be attached to a pivot arm and the first and second force generating devices, 54, and 56, may urge the drive wheel 20 toward the idler wheel 18 with different degrees of force.

The first force generating device 54 may provide the first nip force $F_1$ which holds the idler wheel 18 in rolling engagement with the drive wheel 20. The first force generating device 54 may develop a relatively low force sufficient to maintain contact between the idler wheel 18 and the drive wheel 20. For example $F_1$ may be approximately 0.1 to 0.5 pounds. When a sheet 12 first encounters the nip 16 and separates the idler wheel 18 from the drive wheel 20, the sheet acts against the relatively low force, $F_1$. The first force generating device 54 may include a spring 58 or other biasing device disposed between the pivot arm first end and a structure 60 such as a portion of a frame. As the sheet 12 enters the nip 16, the idler wheel 18 is pivoted against the low force $F_1$. The formed nip gap 40 is enlarged until it eventually reached a size equal to the thickness of the sheet. At this point, further movement of the idler wheel 18 against the first nip force $F_1$ ceases.

When the nip gap 40 equal the thickness of the sheet 12, the nip force generator 42 may engage the second force generating device 56 to develop the second nip force $F_2$. The second force generating device 56 may be engaged in response to a signal generated when the idler wheel 18 has traveled a predetermined amount. Such a signal would be related to the nip gap size. Alternatively, engagement of the second force generating device 56 may be engaged after the sheet has reached a certain position or after a predetermined amount of time has elapsed after the sheet 12 has entered the nip 21. The second nip force $F_2$, may be sufficient to allow the nip assemblies 16 to drive the sheet there through without slippage. For example, the second nip force $F_2$ may be on the order of 1 to 3 pounds. However, other force values may be employed. The higher second nip force $F_2$ is not generated until the nip gap 40 has reached the thickness of the sheet 12.

The second force generating device 56 may include an actuator 62 that has first and second operating states. The actuator 62 may be selectively energized to change operating states to apply the second nip force $F_2$ at desired periods during the travel of the sheets through the nips 21. The actuator 62 may include, for example, a linear drive such as a solenoid or pneumatic cylinder. The actuator 62 may be operably connected to the pivot arm 50 such that it urges the idler wheel 18 and drive wheel 20 together creating the second nip force $F_2$. The actuator 62 may be connected to the pivot arm 50 by a second biasing device 64. The second biasing device 64 may include a spring having one end attached to the actuator 62 and the other end connected to the pivot arm 50. Energizing the actuator 62 causes the spring to be pulled, thereby urging the idler wheel 18 toward the drive wheel 20 and developing the second nip force $F_2$. With the nips compressed onto the sheets by the second nip force $F_2$, the nip may propel the sheet through the nips 21 without slippage. Accordingly, by selectively energizing the actuator 62, the second nip force $F_2$ may be selectively engaged and disengaged.

Figure 5:
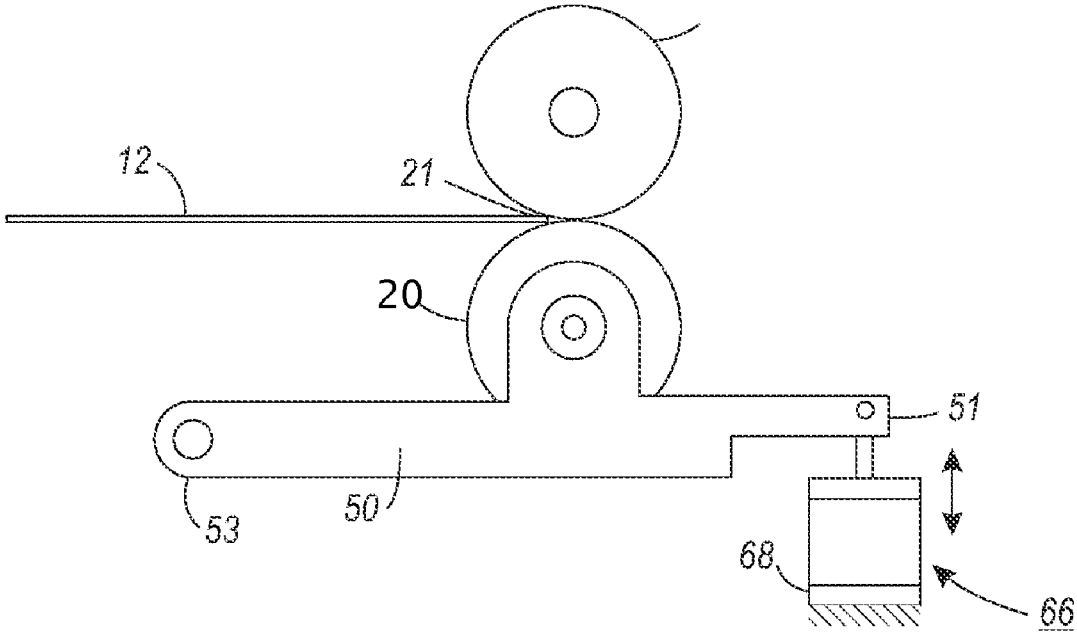
FIG. 5 is a side elevational schematic view of an alternative embodiment of the present disclosure.

In alternative embodiment shown in FIG. 5, the nip force generator 66 may produce the first and second nip forces using a single actuator 68. An actuator 68 capable of generating a variable output force, such as a fluid power or electric linear drive, may be secured to a first end 51 of the pivot arm 50. Pivot arm 50 may be pivotally connected to a structure at a pivot arm second end 52. As shown in FIG. 5, the drive wheel 20 may be pivotally attached to the pivot arm 50. Alternatively, the idler wheel 18 may be pivotally secured to the pivot arm 50. The actuator 68 may be controlled to assume a first operating state urging the drive wheel 20 into the idler wheel 18 thereby generating the first nip force $F_1$. The relatively low first nip force $F_1$ may be generated when the sheet is entering the nips 21. The actuator 68 may also be controlled to assume a second operating state to generate the second nip force $F_2$, which is greater than the first nip force $F_1$. The second nip force $F_2$ may be generated after the sheet has entered the nip and is of a value sufficient to permit the nip to drive the sheet 12 therethrough without slippage.

In sheet transport system 10 having multiple nip assemblies 16 as shown in FIG. 1, each nip assembly 16 may have its own the nip force generator 42 having first and second force generating devices. Alternatively, the idler wheels may be coupled together (not shown) and a single the nip force generator 42 may act on all the nip assemblies 16.

Figure 6:
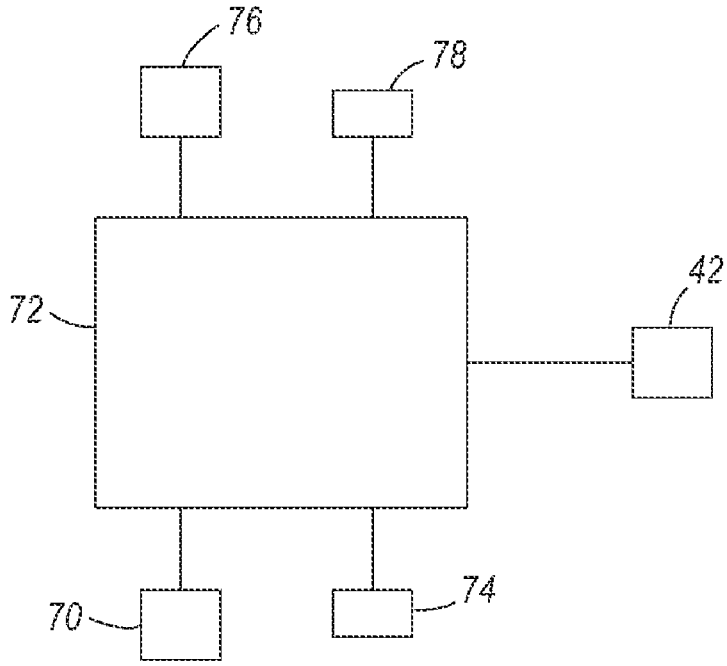
FIG. 6 is a schematic of a nip gap control system.

With reference to FIGS. 1 and 6, the second nip force $F_2$ may be produced in response to one or more sensors 70 which determine the thickness of the sheets. Signals from the sensors 70 may be communicated to a controller 72. The controller 72 may be operably connected to the nip force generator 42. Alternatively, the sheet thickness may be entered by an operator via an input device 74. A nip gap sensor 76 may sense the size of the nip gap 40. When the nip gap 40 reaches the sheet thickness, the controller 72 may cause the nip force generator 42 to produce the second nip force $F_2$. When a sheet has left the nips the controller 72 may cause the nip force generator 42 to de-energize the actuator such that only the first nip force $F_1$ acts on the nip assemblies 16. The nip assemblies 16 are then ready to receive another sheet.

Alternatively, the control of the nip force generator 42 may be responsive to a sheet position sensor 78. When the sheet is about to enter the nip, the nip force generator 42 may generate the first nip force $F_1$. When the position of the sheet is sensed indicating that the sheet has fully entered the nip 21, the nip force generator 42 may generate the second nip force $F_2$.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for transporting substrate media comprising:

a nip assembly including a drive wheel operably connected to a drive mechanism for rotating the drive wheel, and an idler wheel disposed adjacent the drive wheel, the idler wheel and drive wheel forming a nip, the drive wheel and idler wheel being displaceable from each other to form a nip gap therebetween; and a nip force generator operably connected to the nip assembly, the nip force generator developing a first nip force upon entry of the substrate media into the nip and during formation of the nip gap and the nip force generator including a second force generating device for developing a second nip force subsequent to the first nip force, the second nip force being selectively applied to and removed from the nip assembly, the second nip force being greater than the first nip force, and wherein the idler wheel and drive wheel are displaced a distance from each other by the substrate media forming the nip gap, a second nip force is generated when the nip gap reaches a predetermined value corresponding to the thickness of the substrate media.

2. The apparatus as defined in claim 1, wherein the nip force generator includes a first force generating device for developing the first nip force.

3. The apparatus as defined in claim 2, wherein the first force generating device includes a biasing device.

4. The apparatus as defined in claim 1, wherein the second force generating device includes a biasing device and an actuator operably connected to the biasing device.

5. The apparatus as defined in claim 4, wherein the second force generating device is selectively engaged and disengaged in response to an operating state of the actuator.

6. The apparatus as defined in claim 1, wherein the nip force generator includes an actuator, the actuator having a first operating state wherein the first nip force is developed and a second operating state wherein the second nip force is developed.

7. The apparatus as defined in claim 1, wherein the idler wheel is rotatably secured to a pivot arm and movable toward and away from the drive wheel, and the nip force generator is operably connected to the pivot arm.

8. An apparatus for mitigating nip disturbances caused by substrate media entering a nip comprising:

a nip assembly including a drive wheel operably connected to a drive mechanism for rotating the drive wheel, and an idler wheel disposed adjacent the drive wheel, the drive and idler wheels being movable relative to each other to form a nip gap therebetween;

a first force generating device for generating a first nip force which acts upon the nip assembly upon an initial separation of the drive wheel and the idler; and a second force generating device for selectively generating a second nip force greater than the first nip force which acts upon the nip assembly when the nip gap reaches the thickness of the substrate media.

9. The apparatus as defined in claim 8, wherein the first force generating device includes a first biasing device.

10. The apparatus as defined in claim 8, wherein the second force generating device includes a second biasing device and an actuator, wherein actuation of the actuator generates the second nip force.

11. The apparatus as defined in claim 10, wherein the second biasing device is operably connected to the nip assembly and the actuator is operably connected to the second biasing device, and wherein actuation of the actuator displaces the second biasing device which in turn develops the second nip force.

12. A method of mitigating nip entrance disturbances comprising:

transporting substrate media toward a nip formed between a drive wheel and an idler wheel, the drive wheel and idler wheel being displaceable from each other by action of the substrate media to form a nip gap;

subjecting the substrate media to a first nip force upon entry of the substrate media into the nip and during displacement of the idler wheel from the drive wheel by the substrate media in order to reduce nip disturbances;

sensing a thickness of the substrate media;

sensing the nip gap; and subjecting the substrate media to a second nip force greater than the first nip force when the nip gap reaches the thickness of the substrate media.

13. The method as defined in claim 12, wherein the second nip force is created by a second force generating device including an actuator including a first and second operating condition, and wherein changing the operating condition of the actuator subjects the substrate media to the second nip force.

14. The apparatus as defined in claim 1, further including a nip gap sensor for determining the size of the nip gap, and wherein the nip force generator is operably connected to the nip gap sensor, and the second nip force is generated in response to an output of the nip gap sensor.

15. The apparatus as defined in claim 1, wherein the nip force generator includes an actuator, and the actuator is energized to generate the second nip force.

16. The apparatus as defined in claim 8, further including a sheet position sensor, and the second force generating device being responsive to the sensor wherein the second force generating device is activated when the position of the sheet is sensed as having fully entered the nip.

17. The apparatus as defined in claim 1, wherein the nip force generator is operably connected to a controller, the controller receiving information corresponding to thickness of the substrate media, and the controller causing the nip force generator to impart the second nip force.

18. An apparatus for transporting substrate media comprising:

a nip assembly including a drive wheel operably connected to a drive mechanism for rotating the drive wheel, and an idler wheel disposed adjacent the drive wheel, the idler wheel and drive wheel forming a nip, the drive wheel and idler wheel being displaceable from each other to form a nip gap therebetween; and a nip force generator operably connected to the nip assembly, the nip force generator developing a first nip force upon entry of the substrate media into the nip and during formation of the nip gap and the nip force generator including an actuator, and the actuator is energized to generate a second nip force subsequent to the first nip force, the second nip force being greater than the first nip force, and wherein the idler wheel and drive wheel are displaced a distance from each other by the substrate media forming the nip gap, a second nip force is generated when the nip gap reaches a predetermined value corresponding to the thickness of the substrate media.

19. An apparatus for transporting substrate media comprising:

a nip assembly including a drive wheel operably connected to a drive mechanism for rotating the drive wheel, and an idler wheel disposed adjacent the drive wheel, the idler wheel and drive wheel forming a nip, the drive wheel and idler wheel being displaceable from each other to form a nip gap therebetween; and a nip force generator operably connected to the nip assembly, the nip force generator including a first force generating device for developing a first nip force upon entry of the substrate media into the nip and during formation of the nip gap and the nip force generator including a second force generating device for developing a second nip force subsequent to the first nip force, the second force generating device including a biasing device and an actuator operably connected to the second biasing device, the second nip force being greater than the first nip force, and wherein the idler wheel and drive wheel are displaced a distance from each other by the substrate media forming the nip gap, a second nip force is generated when the nip gap reaches a predetermined value corresponding to the thickness of the substrate media.

20. An apparatus for transporting substrate media comprising:

a nip assembly including a drive wheel operably connected to a drive mechanism for rotating the drive wheel, and an idler wheel disposed adjacent the drive wheel, the idler wheel and drive wheel forming a nip, the drive wheel and idler wheel being displaceable from each other to form a nip gap therebetween;

a nip force generator operably connected to the nip assembly, the nip force generator developing a first nip force upon entry of the substrate media into the nip and during formation of the nip gap and developing a second nip force subsequent to the first nip force, the second nip force being greater than the first nip force, and wherein the idler wheel and drive wheel are displaced a distance from each other by the substrate media forming the nip gap, a second nip force is generated when the nip gap reaches a predetermined value corresponding to the thickness of the substrate media; and a nip gap sensor for determining the size of the nip gap, the nip force generator being operably connected to the nip gap sensor, and the second nip force being generated in response to an output of the nip gap sensor.

21. An apparatus for transporting substrate media comprising:

a nip assembly including a drive wheel operably connected to a drive mechanism for rotating the drive wheel, and an idler wheel disposed adjacent the drive wheel, the idler wheel and drive wheel forming a nip, the drive wheel and idler wheel being displaceable from each other to form a nip gap therebetween;

a nip force generator operably connected to the nip assembly, the nip force generator developing a first nip force upon entry of the substrate media into the nip and during formation of the nip gap and developing a second nip force subsequent to the first nip force, the second nip force being greater than the first nip force, and wherein the idler wheel and drive wheel are displaced a distance from each other by the substrate media forming the nip gap, a second nip force is generated when the nip gap reaches a predetermined value corresponding to the thickness of the substrate media; and the nip force generator being operably connected to a controller, the controller receiving information corresponding to a thickness of the substrate media, and the controller causing the nip force generator to impart the second nip force.

* * * * *